US011063383B2

(12) United States Patent
Chang et al.

(10) Patent No.: US 11,063,383 B2
(45) Date of Patent: Jul. 13, 2021

(54) RECEPTACLE CONNECTOR

(71) Applicant: LS MTRON LTD., Anyang-si (KR)

(72) Inventors: Hyun Ho Chang, Anyang-si (KR); Jung Hoon Choi, Anyang-si (KR); Hyun Woo Lee, Anyang-si (KR)

(73) Assignee: LS MTRON LTD., Anyang-si (KR)

( * ) Notice: Subject to any disclaimer, the term of this patent is extended or adjusted under 35 U.S.C. 154(b) by 0 days.

(21) Appl. No.: 16/793,715

(22) Filed: Feb. 18, 2020

(65) Prior Publication Data

US 2020/0266572 A1 Aug. 20, 2020

(30) Foreign Application Priority Data

Feb. 20, 2019 (KR) ..... 10-2019-0019869
Jan. 30, 2020 (KR) ..... 10-2020-0010936

(51) Int. Cl.
*H01R 13/52* (2006.01)
*H01R 13/502* (2006.01)
*H01R 13/6581* (2011.01)

(52) U.S. Cl.
CPC ..... *H01R 13/502* (2013.01); *H01R 13/5202* (2013.01); *H01R 13/6581* (2013.01)

(58) Field of Classification Search
CPC ..... H01R 13/502; H01R 13/5202; H01R 13/6581; H01R 13/6582
USPC ..... 439/519
See application file for complete search history.

(56) References Cited

U.S. PATENT DOCUMENTS 5,660,558 A * 8/1997 Osanai ..... H01R 13/508 439/353
6,139,350 A * 10/2000 Mathesius ..... H01R 13/6582 439/357
6,358,088 B1 * 3/2002 Nishio ..... H01R 13/436 439/595
6,902,432 B2 * 6/2005 Morikawa ..... H01R 13/6275 439/607.41
8,033,853 B2 * 10/2011 Chang ..... H01R 13/6397 439/304
8,083,535 B2 * 12/2011 Chang ..... H01R 13/6272 439/357
8,152,566 B1 * 4/2012 Little ..... H01R 13/6582 439/607.41
8,388,380 B1 * 3/2013 Van der Steen ... H01R 13/5202 439/607.36
8,439,708 B2 * 5/2013 Colantuono ..... H01R 13/6582 439/660
8,556,658 B2 * 10/2013 Szczesny ..... G02B 6/4278 439/607.2

(Continued)

*Primary Examiner* — Abdullah A Riyami
*Assistant Examiner* — Vladimir Imas
(74) *Attorney, Agent, or Firm* — K&L Gates LLP

(57) ABSTRACT

The present invention relates to a receptacle connector including a plurality of contacts configured to electrically connect a plug connector and a substrate coupled with an electronic device, an insulation portion with which the contacts are coupled, and a shell with which the insulation portion is coupled. Here, the shell includes a shell body, in which an accommodation hole configured to allow the plug connector to be inserted therein is formed, and a restriction portion protruding toward the accommodation hole to restrict a movable distance of the plug connector in an insertion direction in which the plug connector is inserted into the accommodation hole.

12 Claims, 16 Drawing Sheets

(56) References Cited

U.S. PATENT DOCUMENTS

| | | | | |
|---|---|---|---|---|
| 9,343,859 | B2 * | 5/2016 | Choi | H01R 12/7088 |
| 9,385,499 | B2 * | 7/2016 | Guo | H01R 13/405 |
| 9,620,904 | B2 * | 4/2017 | Kao | H01R 13/6582 |
| 9,716,356 | B2 * | 7/2017 | Hsieh | H01R 13/6271 |
| 9,793,655 | B2 * | 10/2017 | Little | H01R 13/6582 |
| 10,074,930 | B2 * | 9/2018 | Zhu | H01R 13/5202 |
| 10,116,090 | B2 * | 10/2018 | Iwamoto | H01R 13/6272 |
| 10,236,628 | B2 * | 3/2019 | Motohashi | H01R 13/506 |
| 10,340,639 | B2 * | 7/2019 | Saito | H01R 13/502 |
| 10,505,309 | B2 * | 12/2019 | Poterjoy | H01R 13/5208 |
| 10,804,641 | B2 * | 10/2020 | Zhou | H01R 13/504 |
| 2013/0183844 | A1 * | 7/2013 | Wang | H01R 24/68 439/271 |
| 2016/0359274 | A1 * | 12/2016 | Zhang | H01R 43/24 |

* cited by examiner

【Figure 1A】
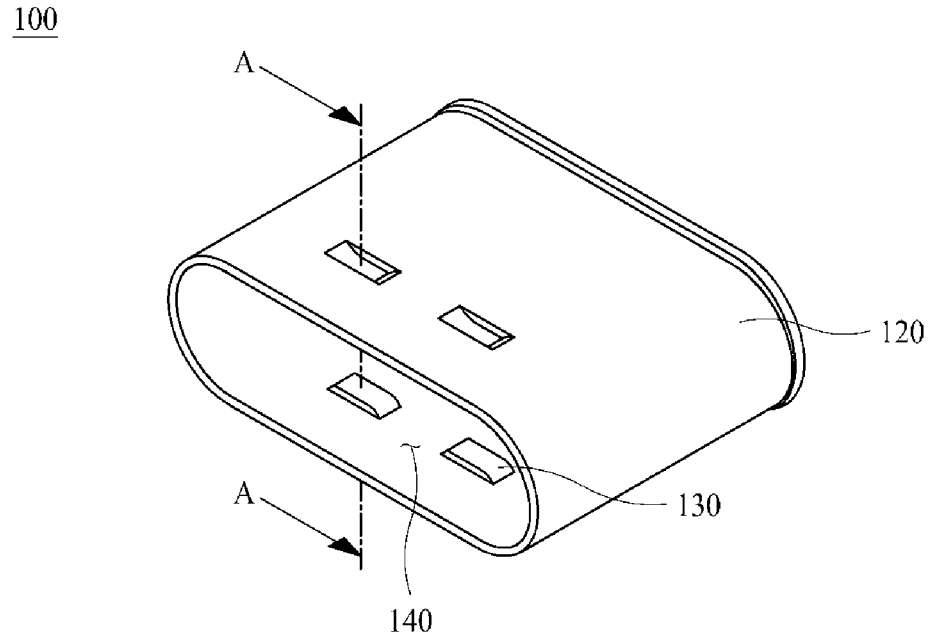
-PRIOR ART-

【Figure 1B】
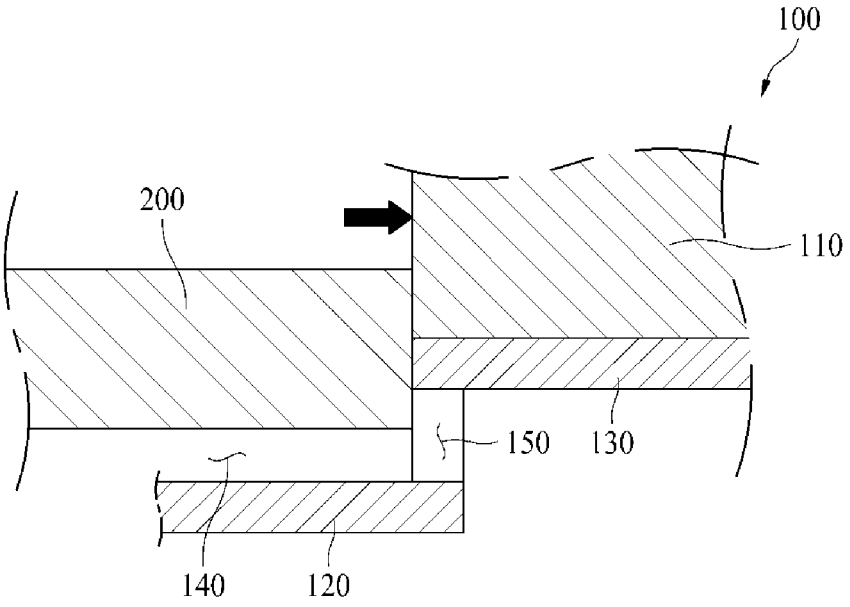
-PRIOR ART-

【Figure 2】
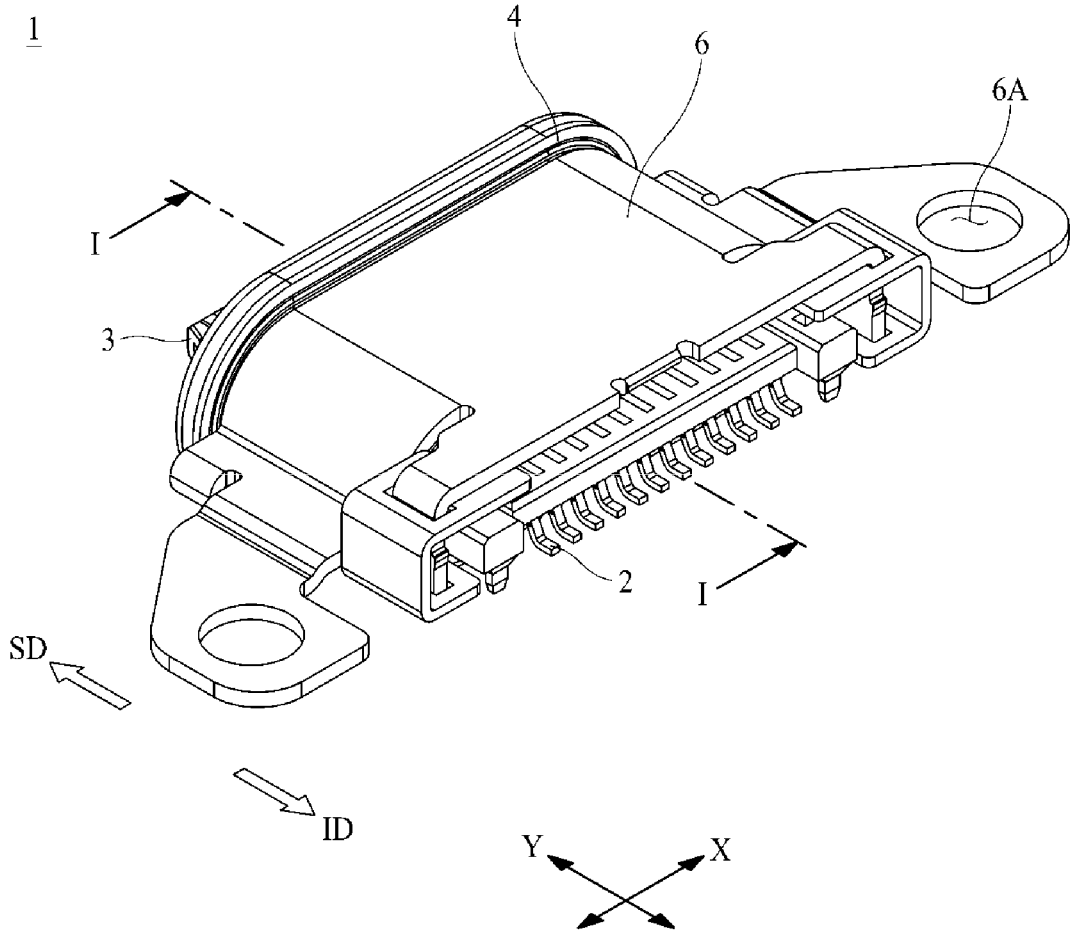

【Figure 3】
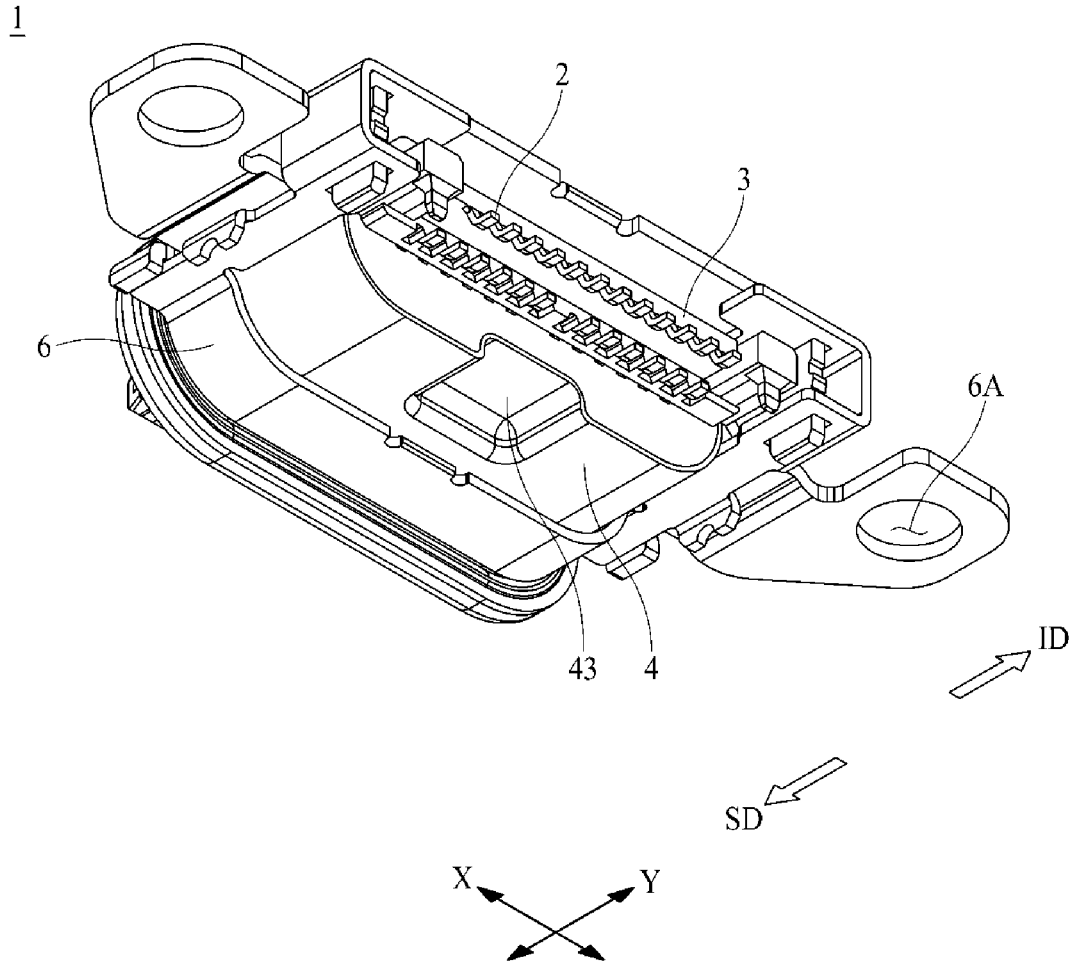

【Figure 4】
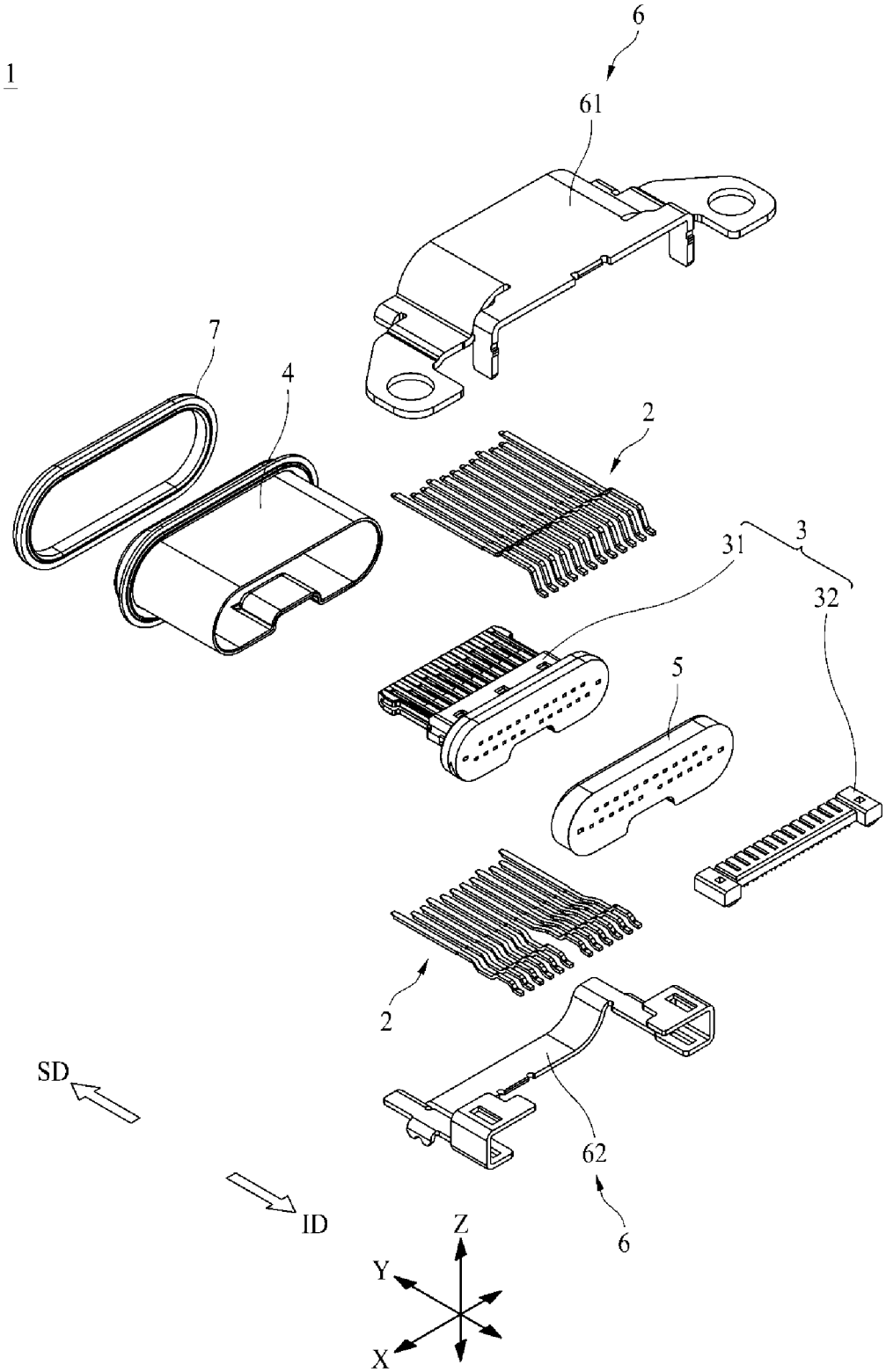

【Figure 5】
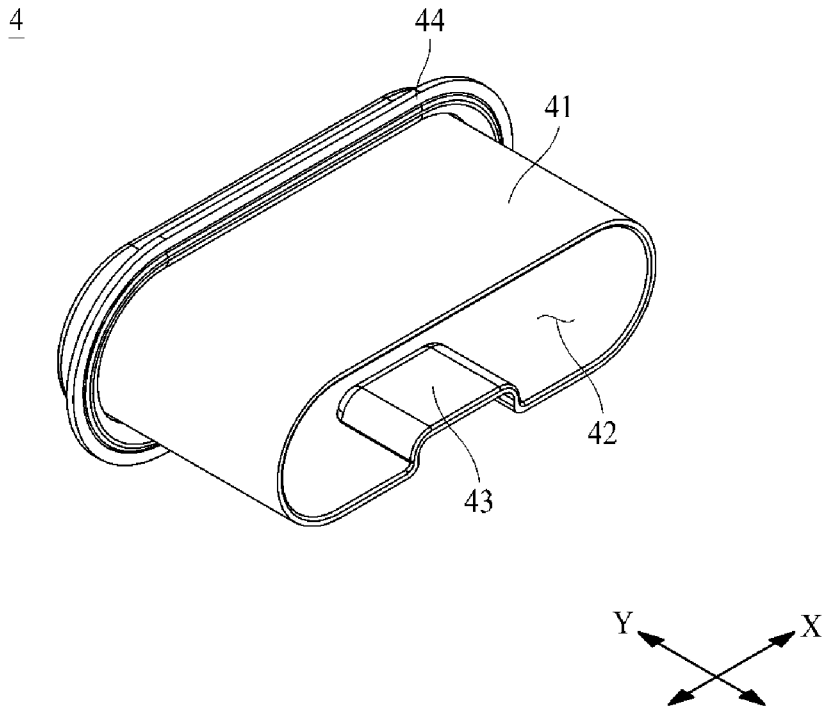

【Figure 6】
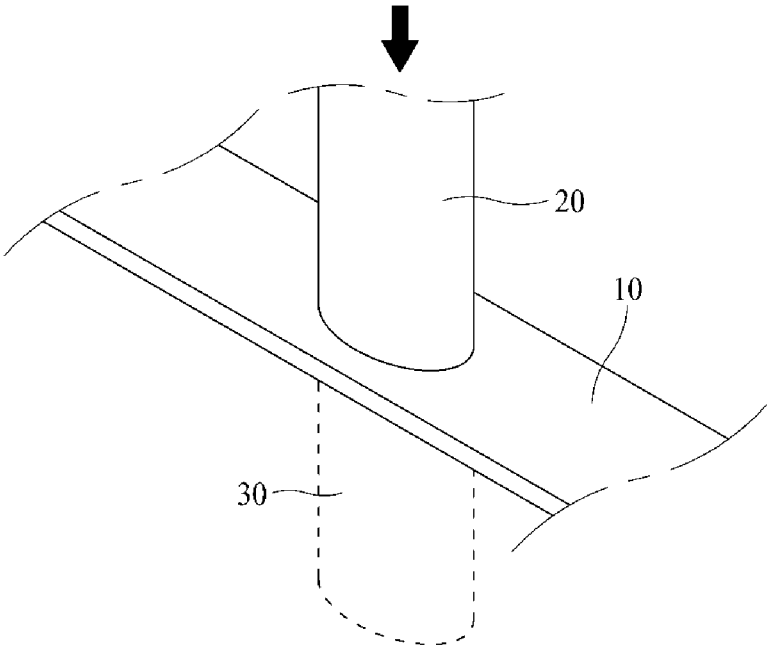

【Figure 7】
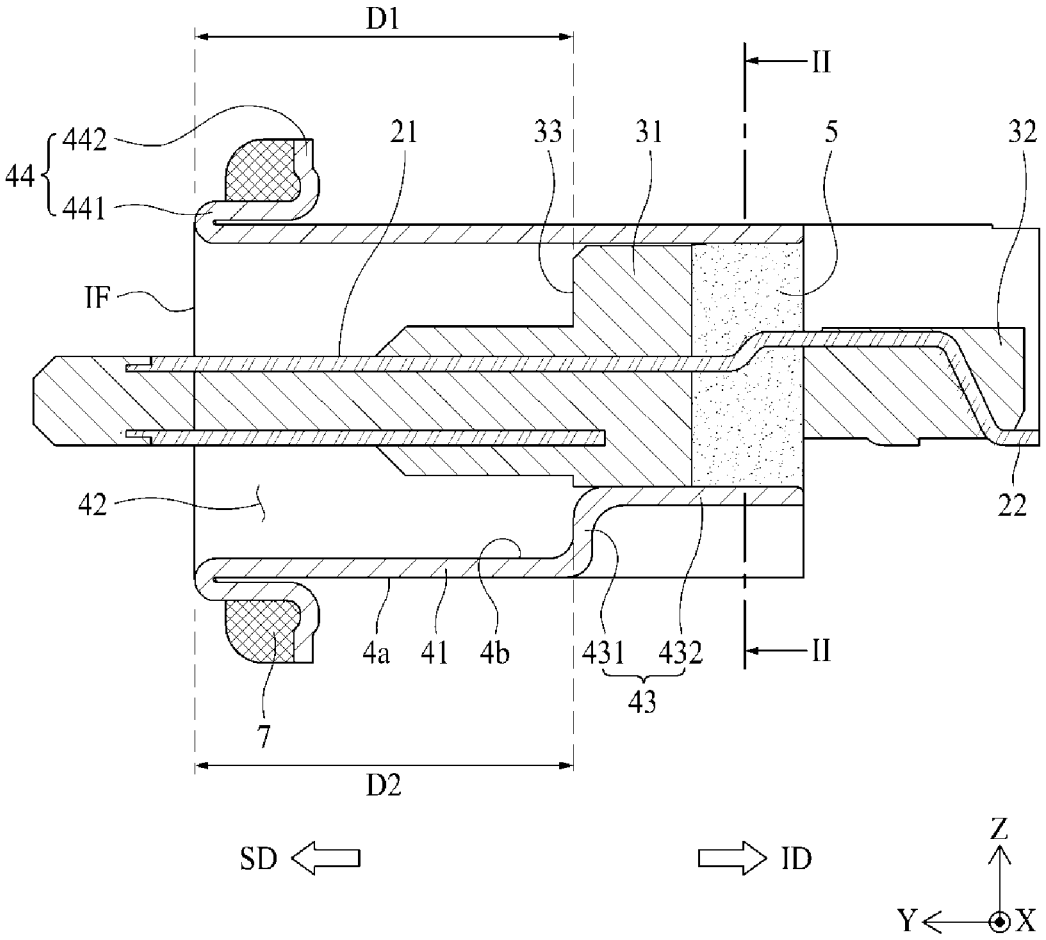

【Figure 8】
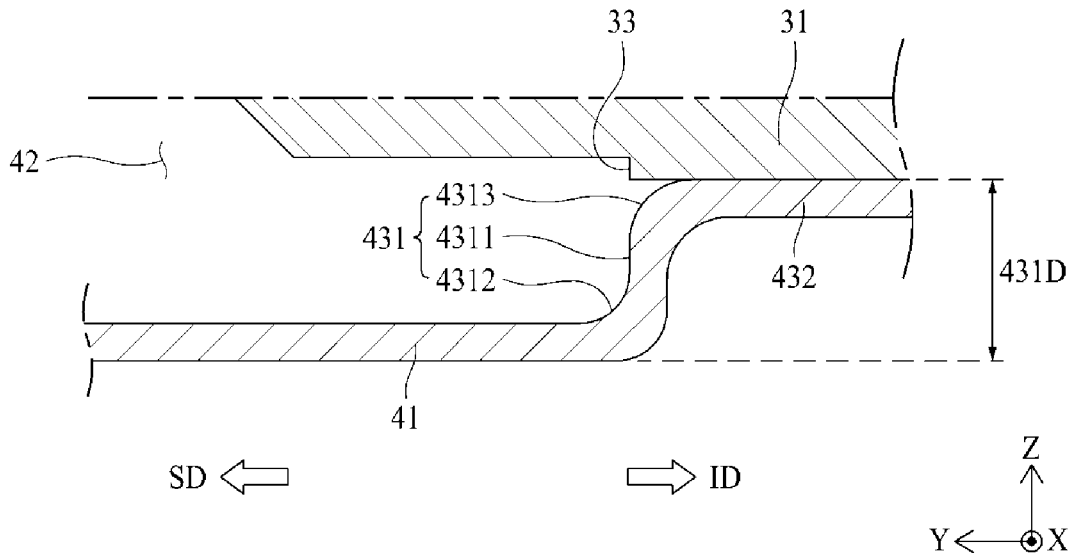

【Figure 9】
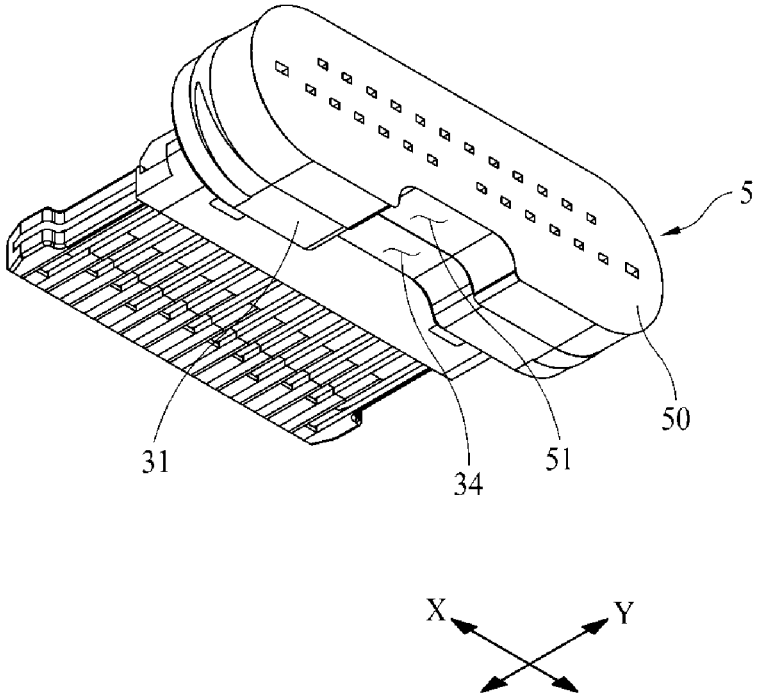

【Figure 10】
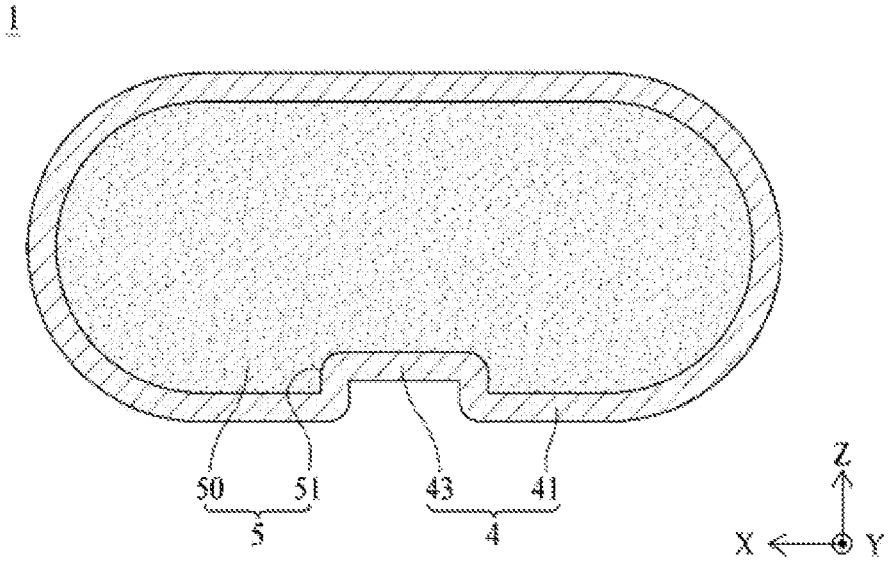
【Figure 11】
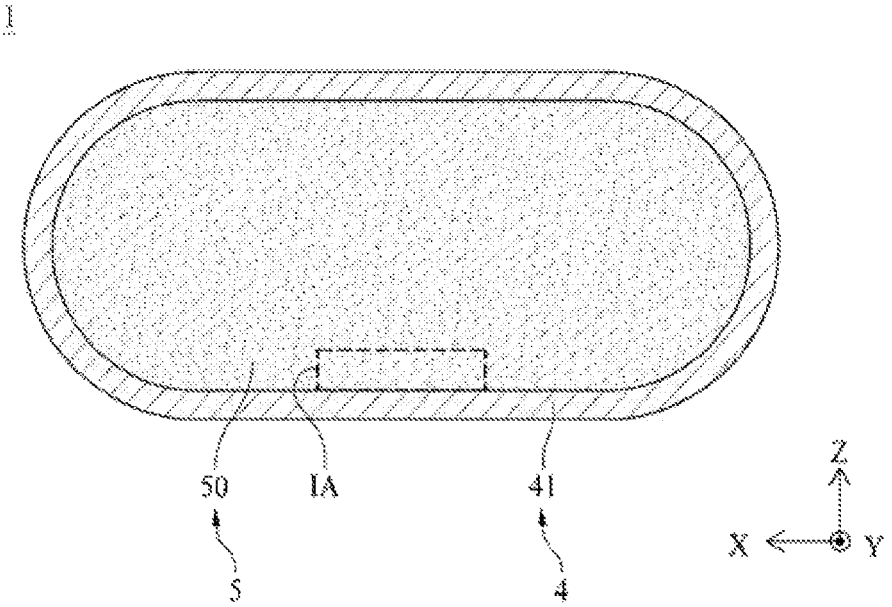

【Figure 12】
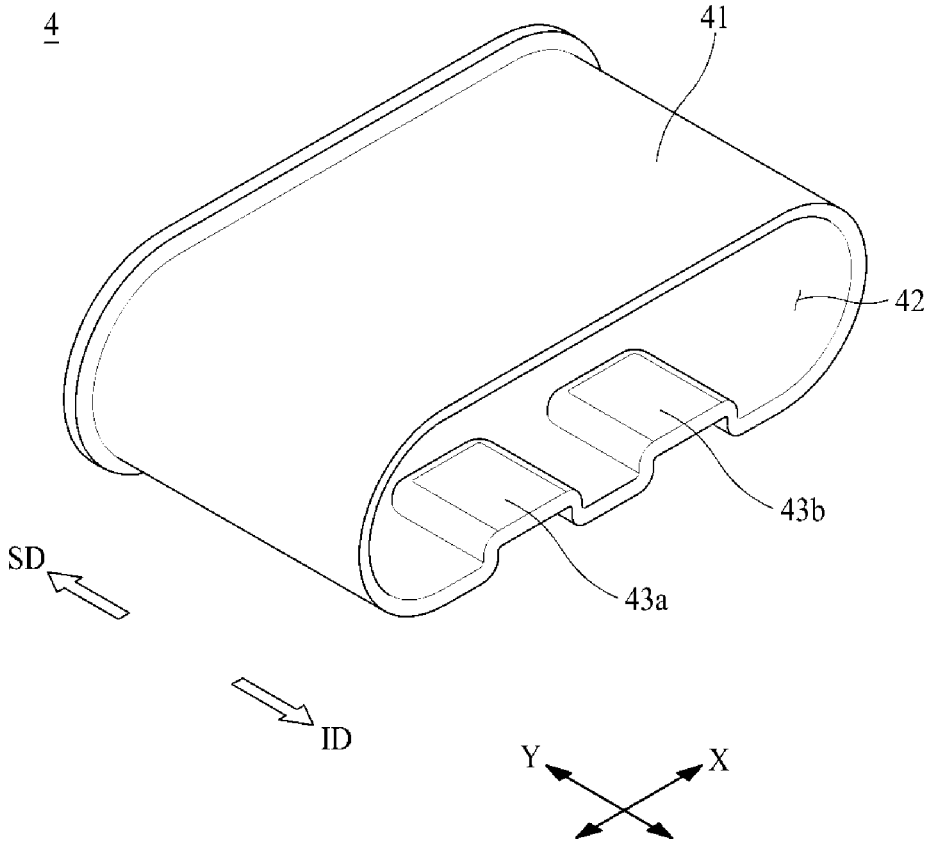

【Figure 13】
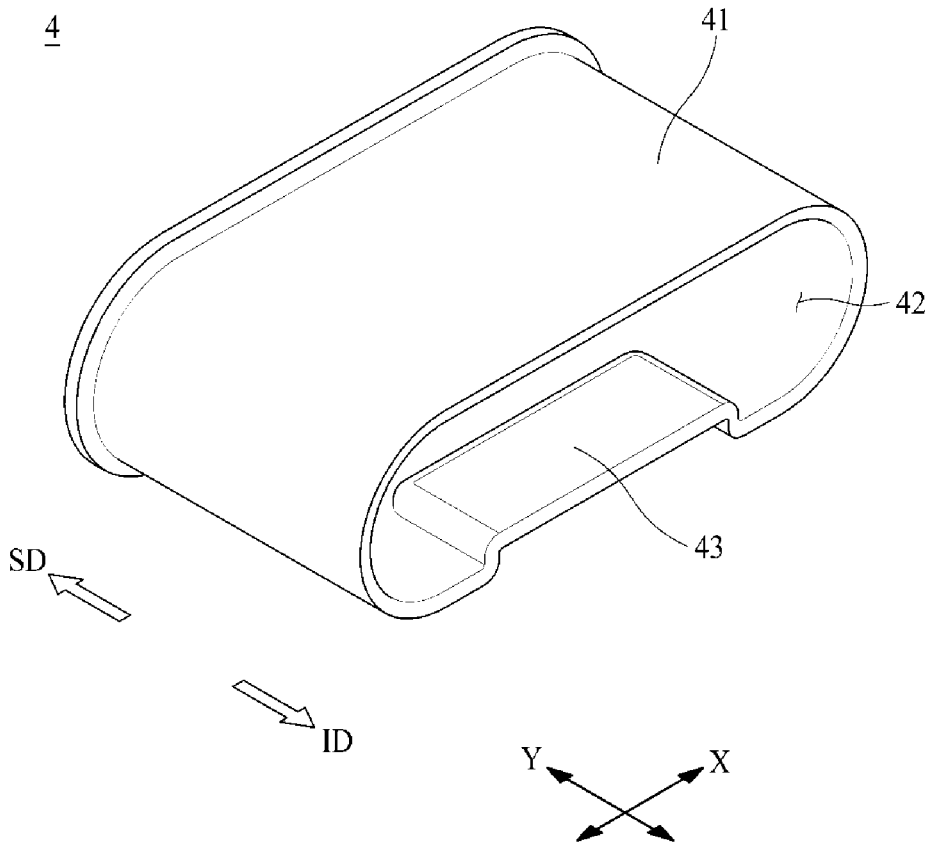

【Figure 14】
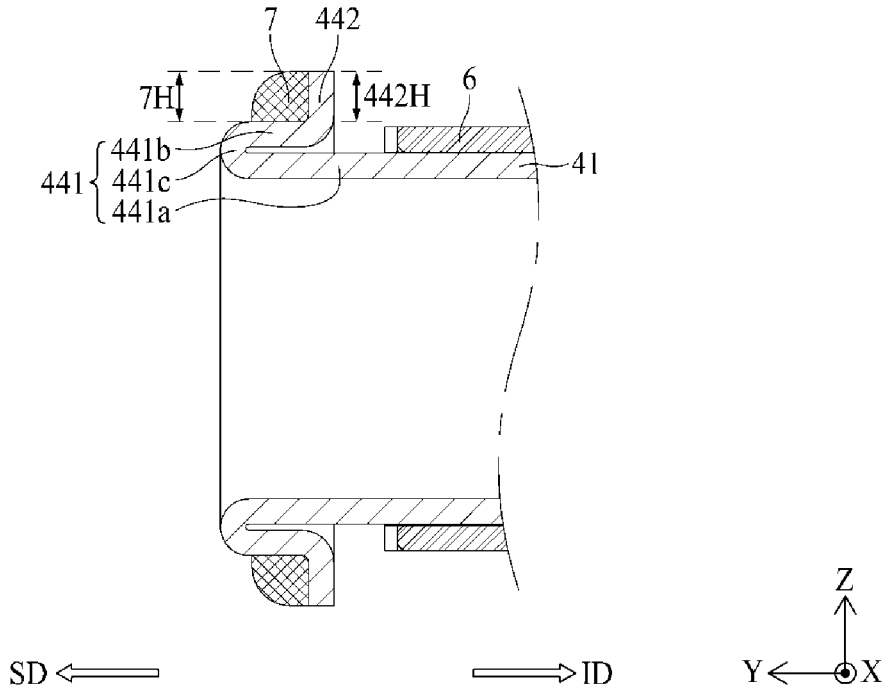
【Figure 15】
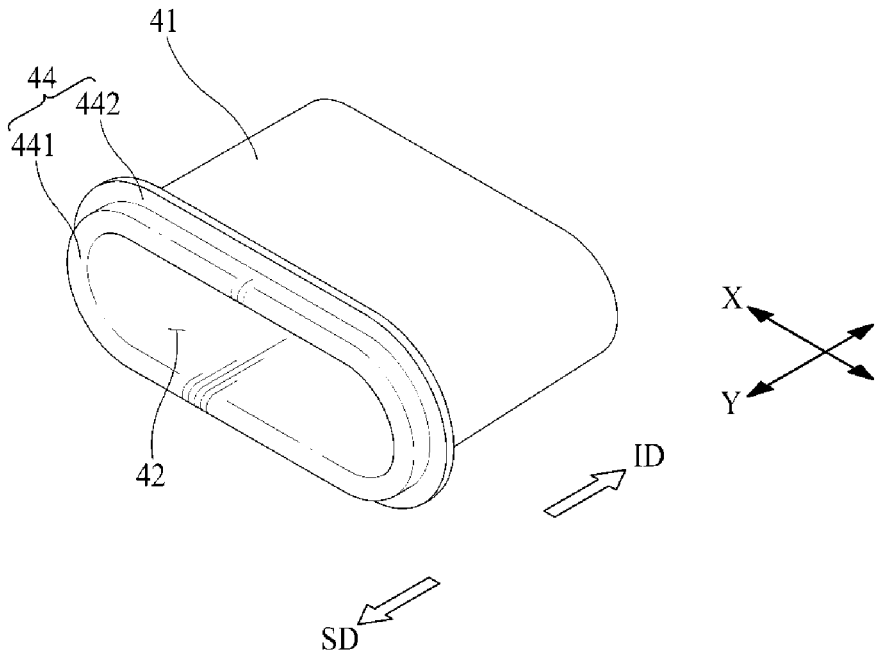

【Figure 16】
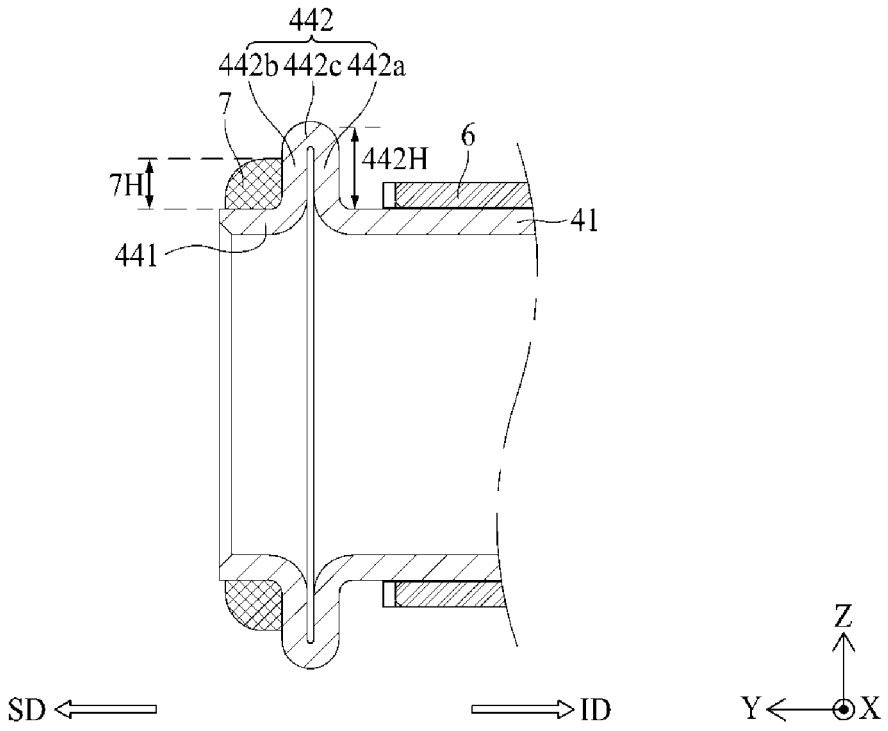

【Figure 17】
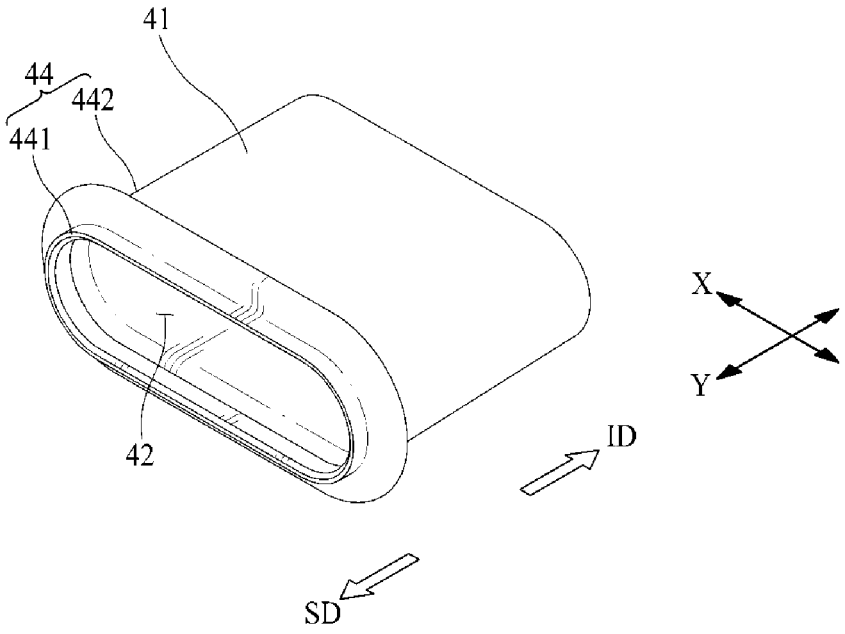

RECEPTACLE CONNECTOR

PRIORITY STATEMENT

This application claims benefit and priority under 35 U.S.C. § 119 to Korean Patent Application No. 10-2019-0019869, filed Feb. 20, 2019 and Korean Patent Application No. 10-2020-0010936, filed Jan. 30, 2020, the entire contents of each of which are being incorporated herein by reference.

FIELD OF TECHNOLOGY

The present invention relates to a receptacle connector coupled with an electronic device for connection with a plug connector.

BACKGROUND

Generally, receptacle connectors are coupled with substrates provided in a variety of electronic devices for connection with corresponding plug connectors. For example, a receptacle connector may be installed in an electronic device such as a portable computer, a cellular phone, and the like and used to perform a charging function, a data transmission function, and the like.

Recently, as electronic devices such as a cellular phone and the like are required to be equipped with a completely waterproof function which is strengthened more than average waterproofing, development of receptacle connectors having an enhanced waterproof function have been actively performed.

FIGS. 1A and 1B are schematic side cross-sectional views of a receptacle connector according to a related art.

Referring to FIGS. 1A and 1B, a receptacle connector 100 according to a related art includes a plurality of contacts (not shown) to allow a plug connector 200 (refer to FIG. 1B) to be connected thereto, an insulation portion 110 configured to support the contacts, a shell 120 configured to provide a connection space in which the plug connector 200 is connected to the contacts, and a restriction portion 130 configured to restrict movement of the plug connector 200 to be inserted into an accommodation hole 140 formed in the shell 120.

The restriction portion 130 may come into contact with the plug connector 200 so as to support the plug connector 200. Accordingly, the restriction portion 130 may perform a function of preventing the insulation portion 110 from being damaged and destroyed by preventing the plug connector 200 from being excessively inserted. The restriction portion 130 may be formed by tearing a part of the shell 120 to fold down toward the accommodation hole 140.

Here, the receptacle connector 100 according to the related art is embodied to form an interval 150 between the shell 120 and the restriction portion 130 during a process of forming the restriction portion 130. Accordingly, in the receptacle connector 100 according to the related art, since water and the like permeates through the interval 150 such as to cause failures of the contacts, water performance is degraded.

Also, the receptacle connector 100 according to the related art is implemented such that a great deal of stress is concentrated on the restriction portion 130 during a process in which receptacle connector 100 comes in contact with the restriction portion 130. Accordingly, the receptacle connector 100 according to the related art has a problem that a possibility of damaging or destroying the restriction portion 130 increases due to stress concentration such that a service life of the shell 120 is reduced and maintenance and repair costs increase.

SUMMARY

Therefore, the present invention is designed to solve the problems and is for providing a receptacle connector capable of improving waterproof performance.

The present invention is for providing a receptacle connector capable of easing stress concentration on a restriction portion.

To solve the above problems, the present invention includes the following configuration.

A receptacle connector according to the present invention may include a plurality of contacts configured to electrically connect a plug connector and a substrate coupled with an electronic device, an insulation portion with which the contacts are coupled, and a shell with which the insulation portion is coupled. The shell include a shell body, in which an accommodation hole configured to allow the plug connector to be inserted therein is formed, and a restriction portion protruding toward the accommodation hole to restrict a movable distance of the plug connector in an insertion direction in which the plug connector is inserted into the accommodation hole. The shell body and the restriction portion may be integrally formed without a joint. The restriction portion may include a restriction member for supporting the plug connector. The restriction member may be formed to be a flat surface and include a restriction surface configured to support the plug connector, a first dispersion surface connected to the restriction surface, and a second dispersion surface connected to the restriction surface at a position which is spaced apart from the first dispersion surface. The second dispersion surface and the first dispersion surface may be formed to be curved surfaces.

According to the present invention, the following effects can be promoted.

The present invention can improve waterproof performance by fundamentally closing off a possibility of water and the like permeating into a shell.

The present invention can prevent an insulating portion from being damaged or destroyed due to a plug connector being inserted to an excessive depth or prevent waterproof performance from being degraded.

The present invention can be implemented to disperse stress applied to a restriction portion so as to reduce a possibility of the restriction portion being damaged or destroyed.

BRIEF DESCRIPTION OF THE DRAWINGS

FIG. 1A is a schematic perspective view illustrating a shell of a receptacle connector according to a related art.

FIG. 1B is a schematic side cross-sectional view of the receptacle connector according to the related art, which is taken along line A-A of FIGS. 1A and 1*n* which a plug connector is inserted into the shell.

FIG. 2 is a schematic perspective view of a receptacle connector according to the present invention.

FIG. 3 is a schematic bottom perspective view of the receptacle connector according to the present invention.

FIG. 4 is a schematic exploded perspective view of the receptacle connector according to the present invention.

FIG. 5 is a schematic perspective view of a receptacle connector according to the present invention.

FIG. 6 is a concept view illustrating a method of integrally forming a shell body and a restriction portion without a joint in the receptacle connector according to the present invention.

FIG. 7 is a schematic side cross-sectional view illustrating contacts, an insulation portion, a shell, and a waterproof portion of the receptacle connector according to the present invention taken along line I-I of FIG. 2.

FIG. 8 is an enlarged view illustrating the restriction portion of the receptacle connector according to the present invention.

FIG. 9 is a bottom perspective view illustrating the insulation portion and the waterproof portion of the receptacle connector according to the present invention.

FIG. 10 is a schematic front cross-sectional view illustrating the receptacle connector according to the present invention on the basis of line II-II of FIG. 7.

FIG. 11 is a schematic front cross-sectional view illustrating a comparative example in which the restriction portion is not formed on the basis of line II-II of FIG. 7.

FIG. 12 is a schematic perspective view illustrating a first embodiment of a restriction portion of a receptacle connector according to a modified embodiment of the present invention.

FIG. 13 is a schematic perspective view illustrating a second embodiment of a restriction portion of a receptacle connector according to a modified embodiment of the present invention.

FIG. 14 is a schematic side cross-sectional view illustrating one embodiment of a support portion of the receptacle connector according to the present invention taken along line I-I of FIG. 2.

FIG. 15 is a schematic rear perspective view illustrating one embodiment of the support portion of the receptacle connector according to the present invention.

FIG. 16 is a schematic side cross-sectional view illustrating another embodiment of a support portion of the receptacle connector according to the present invention taken along line I-I of FIG. 2.

FIG. 17 is a schematic perspective view illustrating another embodiment of the support portion of the receptacle connector according to the present invention.

DETAILED DESCRIPTION

Hereinafter, embodiments of a receptacle connector according to the present invention will be described in detail with reference to the attached drawings.

Referring to FIGS. 2 to 4, a receptacle connector 1 according to the present invention is coupled with a substrate (not shown) provided in a variety of electronic devices for connection with a plug connector 200 (refer to FIG. 1). The substrate may be a printed circuit board (PCB).

Referring to FIGS. 2 to 8, the receptacle connector 1 according to the present invention includes a plurality of contacts 2 configured to electrically connect the plug connector 200 and a substrate coupled with an electronic device, an insulation portion 3 to which the contacts 2 are coupled, and a shell 4 to which the insulation portion 3 is coupled. The shell 4 includes a shell body 41, in which an accommodation hole 42 to allow the plug connector 200 to be inserted therein is formed, and a restriction portion 43 which protrudes toward the accommodation hole 42 to restrict a movable distance of the plug connector 200 in an insertion direction in which the plug connector 200 is inserted into the accommodation hole 42. The shell body 41 and the restriction portion 43 are integrally formed without a joint. The restriction portion 43 includes a restriction member 431 for supporting the plug connector 200. The restriction member 431 includes a restriction surface 4311 formed to be a flat surface for supporting the plug connector 200, a first dispersion surface 4312 connected to the restriction surface 4311, and a second dispersion surface 4313 connected to the restriction surface 4311 at a position spaced apart from the first dispersion surface 4312. The second dispersion surface 4313 and the first dispersion surface 4312 are formed to be curved sides. Accordingly, the receptacle connector 1 according to the present invention may promote performance effects as follows.

First, the receptacle connector 1 according to the present invention is implemented so that the shell body 41 and the restriction portion 43 are integrally formed without a joint. Accordingly, the receptacle connector 1 according to the present invention may improve waterproof performance by fundamentally preventing a possibility of water and the like from penetrating during a process of manufacturing the restriction portion 43 in comparison to a related art in which an interval 150 (refer to FIG. 1) is formed between the shell body 41 and the restriction portion 43. Also, in the receptacle connector 1 according to the present invention, since an additional operation such as tapping and the like for filling the interval 150 is not necessary, manufacturing costs may be reduced by reducing the number of operations for achieving waterproof performance and productivity may also be increased by reducing a manufacturing time.

Second, in the receptacle connector 1 according to the present invention, when the plug connector 200 is supported by the restriction surface 4311 while being inserted into the accommodation hole 42, the plug connector 200 cannot move further in the insertion direction (an ID arrow direction). Accordingly, the receptacle connector 1 according to the present invention may prevent the insulation portion 3 from being damaged or destroyed or prevent waterproof performance from being degraded due to the plug connector 200 being inserted into the accommodation hole 42 to an excessive depth by restricting a movable distance of the plug connector 200 being inserted into the accommodation hole 42 which is movable in the insertion direction (the ID arrow direction) using the restriction member 431.

Third, the receptacle connector 1 according to the present invention is implemented so that the restriction member 431 includes the dispersion surfaces 4312 and 4313 formed to be curved sides in addition to the restriction surface 4311. The dispersion surfaces 4312 and 4313 may come into contact with different parts of the plug connector 200 when the plug connector 200 is inserted into the accommodation hole 42 and supported by the restriction surface 4311. Accordingly, the dispersion surfaces may disperse stress applied to the restriction member 431 during a process in which the plug connector 200 is inserted into the accommodation hole 42. Accordingly, in comparison to a related art implemented such that stress is concentrated on the restriction member 431, the receptacle connector 1 according to the present invention may increase a service life of the shell 4 as well as reduce maintenance and repair costs by reducing a possibility of damaging or destroying the restriction member 431 using the dispersion surfaces 4312 and 4313.

Hereinafter, the contacts 2, the insulation portion 3, and the shell 4 will be described in detail with reference to the attached drawings.

Referring to FIGS. 2 to 4 and 7, the contacts 2 are configured to electrically connect the plug connector 200 to the substrate. The contacts 2 are connected to the plug connector 200 inserted into the shell 4 while being mounted on the substrate so that the plug connector 200 and the substrate may be electrically connected. The contacts 2 may be formed of a conductive material. The contacts 2 may be coupled with the insulation portion 3. The plurality of contacts 2 may be coupled with the insulation portion 3.

Referring to FIG. 7, each of the contacts 2 may include a connection member 21 and a mounting member 22.

The connection member 21 is configured to be connected to the plug connector 200. Some of the contacts 2 may be coupled to the insulation portion 3 so that the connection members 21 are located on one surface of the insulation portion 3. The connection members 21 located on the one surface of the insulation portion 3 may be arranged to be spaced apart from each other in a first axial direction (X-axis direction). Some of the others of the contacts 2 may be coupled to the insulation portion 3 so that the connection members 21 are located on the other surface of the insulation portion 3. The connection members 21 located on the other surface of the insulation portion 3 may be arranged to be spaced apart from each other in the first axial direction (X-axis direction). The one surface and the other surface of the insulation portion 3 are surfaces opposite to each other. The one surface of the insulation portion 3 may be a top surface of the insulation portion 3. The other surface of the insulation portion 3 may be a bottom surface of the insulation portion 3. The first axial direction (X-axis direction) may be an axial direction perpendicular to the insertion direction (the ID arrow direction).

The mounting member 22 is configured to be mounted on the substrate. Each of the contacts 2 may electrically connect the plug connector 200 to the substrate as the plug connector 200 is connected to the connection member 21 while the mounting member 22 is mounted on the substrate. In this case, the plug connector 200 connected to the connection member 21 may be electrically connected to the substrate through the mounting member 22.

Referring to FIGS. 2 to 4, 7, 8, and 9 to 11, the contacts 2 are coupled to the insulation portion 3. The insulation portion 3 supports the contacts 2. The contacts 2 may be coupled to and supported by the insulation portion 3. The contacts 2 may be coupled with a top surface and a bottom surface of the insulation portion 3. The insulation portion 3 may be inserted into and coupled to the shell 4 so that the connection members 21 are located inside the shell 4. In this case, some of the connection members 21 may be located outside the shell 4. The insulation portion 3 may be inserted into and coupled to the shell 4 so that the mounting members 22 are located outside the shell 4. The insulation portion 3 may be formed of an insulating material such as rubber and the like.

Referring to FIGS. 4 and 7, the insulation portion 3 may include a first insulation member 31 and a second insulation member 32.

The first insulation member 31 is configured to support the contacts 2. The first insulation member 31 may form an overall exterior of the insulation portion 3. Some of the contacts 2 may be coupled to the first insulation member 31 so that the connection members 21 are located on a top surface of the first insulation member 31. Some of the contacts 2 may be coupled to the first insulation member 31 so that the connection members 21 are located on a bottom surface of the first insulation member 31. The first insulation member 31 and the contacts 2 may be implemented to be coupled with each other through insert molding.

The second insulation member 32 is configured to support the contacts 2. The second insulation member 32 and the first insulation member 31 may be arranged to be spaced apart from each other in a second axial direction (Y-axis direction). The second axial direction (Y-axis direction) and the first axial direction (X-axis direction) are perpendicular to each other on a level side. The second insulation member 32 may be disposed in the insertion direction (the ID arrow direction) with respect to the first insulation member 31 while the insulation portion 3 is inserted in the shell 4. The contacts 2 may be coupled with the second insulation member 32 so that the mounting members 22 are located at the same height. The second insulation member 32 and the contacts 2 may be implemented to be coupled with each other through insert molding.

Referring to FIG. 7, the insulation portion 3 may include a facing surface 33.

The facing surface 33 is a surface of the insulation portion 3 in a separation direction (SD arrow direction). The facing surface 33 may face the plug connector 200 while the plug connector 200 is inserted in the shell 4. The facing surface 33 may be formed on the first insulation member 31. The facing surface 33 may be one surface of the first insulation member 31 in the separation direction (SD arrow direction). The separation direction (SD arrow direction) and the insertion direction (ID arrow direction) may be parallel to the second axial direction (Y-axis direction) and opposite to each other.

The facing surface 33 may be disposed to be spaced at a first distance D1 (refer to FIG. 7) from an insertion reference surface IF (refer to FIG. 7) on the basis of the second axial direction (Y-axis direction). The insertion reference surface IF is formed on one end of the shell 4 where insertion of the plug connector 200 starts. The insertion reference surface IF may be formed along a direction parallel to a third axial direction (Z-axis direction). The third axial direction (Z-axis direction) may correspond to a direction perpendicular to each of the first axial direction (X-axis direction) and the second axial direction (Y-axis direction) as well as to a direction equal to a direction in which an overall height of the receptacle connector 1 according to the present invention increases or decreases.

Referring to FIGS. 2 to 17, the shell 4 is configured to provide a connection space in which the plug connector 200 is connected to the contacts 2. The plug connector 200 may move in the insertion direction (ID arrow direction) and be inserted into the shell 4 so as to be connected to the contacts 2. When the receptacle connector 1 according to the present invention corresponds to standards of USB type_C, the plug connector 200 may be connected to some of the contacts 2. The plug connector 200 may move in the separation direction (SD arrow direction) and be detached from the shell 4 so as to be separated from the contacts 2.

The shell 4 may support the insulation portion 3. The insulation portion 3 may move in the separation direction (SD arrow direction) and be inserted into the shell 4 while contacts 2 are coupled therewith. The shell 4 may be formed of a metal material.

The shell 4 may include the shell body 41 and the accommodation hole 42.

The shell body 41 is configured to protect the contacts 2 and the insulation portion 3 located in the accommodation hole 42 from the outside. The shell body 41 may form an overall exterior of the shell 4. The shell body 41 may be formed to have an overall hollow elliptical oblong shape but is not limited thereto, and any other shapes capable of protecting the contacts 2 and the insulation portion 3 from the outside are applicable.

The shell body 41 may be integrally formed without a joint. Accordingly, an outer surface 4*a* (refer to FIG. 7) of the shell 4 is implemented without a gap caused by a joint. Accordingly, in comparison to the related art shown in FIGS. 1A and 1B which is required to perform an additional operation such as tapping and the like for filling a joint, the receptacle connector 1 according to the present invention may be implemented so that the shell 4 has a waterproof function without an additional operation. Accordingly, in comparison to a comparative example, the receptacle connector 1 according to the present invention may reduce manufacturing costs by reducing the number of operations and increase productivity by reducing manufacturing time. Also, unlike the comparative example in which water and the like may permeate through a joint, the receptacle connector 1 according to the present invention may fundamentally prevent a possibility of water and the like permeating through a joint so as to further reinforcing waterproof performance in comparison to the comparative example.

The shell body 41 may be integrally formed to have no joint by processing a panel using a deep drawing method. In this case, the shell body 41 may be integrally formed without a joint through a following process.

First, as shown in FIG. 6, while a processing device 20 comes into contact with one surface of a panel 10, the processing device 20 moves downward to a position spaced at a certain distance from the other surface of the panel 10 such that the panel 10 partially elongates. Accordingly, a processing portion 30 with one side surface closed is formed on the panel 10. The processing device 20 is provided in processing equipment and may be, for example, a puncher provided in press equipment. The processing device 20 is formed to have a shape corresponding to the shell body 41. For example, the processing device 20 may be formed to have an elliptical oblong shape. Although not shown in the drawings, the panel 10 may be in a state of being supported by a device of the press equipment.

Next, when the processing portion 30 with one side surface closed is molded by the processing device 20, the processing portion 30 is separated from the panel.

Next, one side surface of the processing portion 30 is cut to be opened. In this case, the other side surface opposite to the one side surface of the processing portion 30 may be formed to be opened as the processing device 20 partially elongates the panel 10. That is, when the processing device 20 which comes into contact with one surface of the panel 10 moves downward and thus the panel 10 is partially elongated, the processing portion 30 with the one side surface closed and the other side surface opened may be molded. Accordingly, when the one side surface of the processing portion 30 is cut and opened, the processing portion 30 is formed to have both side surfaces opened without a joint so as to be manufactured as the shell body 41. In this case, a process of partially processing the other side surface of the processing portion 30 may be performed.

Through the above-described processes, the shell body 41 may be integrally formed without a joint as shown in FIG. 5. Accordingly, in comparison to a comparative example, the receptacle connector 1 according to the present invention may reduce manufacturing costs by reducing the number of operations and being equipped with a waterproof function and increase productivity by reducing manufacturing time. Also, since the receptacle connector 1 according to the present invention is capable of fundamentally preventing a possibility of water and the like permeating through a joint, waterproof performance may be reinforced in comparison to the comparative example.

The accommodation hole 42 is formed to pass through the shell body 41. The accommodation hole 42 may function as a connection space where the plug connector 200 is connected to the contacts 2. The plug connector 200 may move in the insertion direction (ID arrow direction) and be inserted into the accommodation hole 42 so as to be connected to the contacts 2 located in the accommodation hole 42. The accommodation hole 42 may be formed through an operation of processing the panel using a deep drawing method. The accommodation hole 42 may be an overall elliptical oblong shape but is not limited thereto and may be formed to be other shapes capable of functioning as a connection space where the plug connector 200 is connected to the contacts 2.

Referring to FIGS. 3, 5, and 7 to 13, the restriction portion 43 is configured to support the plug connector 200 inserted in the accommodation hole 42. The restriction portion 43 is formed to protrude toward the accommodation hole 42. Accordingly, when the plug connector 200 is supported by the restriction portion 43 while moving in the insertion direction (ID arrow direction) and being inserted into the accommodation hole 42, the plug connector 200 may not further move in the insertion direction (ID arrow direction). Accordingly, the restriction portion 43 may prevent the insulation portion 3 from being damaged or destroyed or prevent waterproof performance from being degraded due to the plug connector 200 being inserted into the accommodation hole 42 at an excessive depth by restricting a movable distance of the plug connector 200 being inserted into the accommodation hole 42 and movable in the insertion direction (the ID arrow direction).

The restriction portion 43 and the shell body 41 may be integrally formed without a joint. Accordingly, even when the restriction portion 43 is provided, the outer surface 4*a* of the shell 4 may be implemented without a gap caused by a joint. Accordingly, the receptacle connector 1 according to the present invention may reinforce a waterproof function by fundamentally preventing a possibility of water and the like permeating through a joint and may also increase a service life by preventing the plug connector from being inserted to an excessive depth. The restriction portion 43 may be formed during a process of processing the shell body 41 using a deep drawing method. As the restriction portion 43 is formed, a groove may be formed in the outer surface 4*a* of the shell 4.

Referring to FIGS. 7 and 8, the restriction portion 43 may include the restriction member 431. The restriction member 431 supports the plug connector 200 inserted in the accommodation hole 42. The restriction member 431 may come into contact with the plug connector 200 and support the plug connector 200. The plug connector 200 may be supported by the restriction member 431 not to move further in the insertion direction (ID arrow direction) when the plug connector 200 comes into contact with the restriction member 431. The restriction member 431 may be formed to protrude toward the accommodation hole 42.

The restriction member 431 may extend to a bottom surface of the insulation portion 3 from an inner surface 4*b* (refer to FIG. 7) of the shell 4 on the basis of the third axial direction (Z-axis direction). Accordingly, the receptacle connector 1 according to the present invention may increase a restricting force of the restriction member 431 by extending a restriction area of the restriction member 431 configured to restrict movement of the plug connector 200 on the basis of the third axial direction (Z-axis direction). The inner surface 4*b* of the shell 4 may correspond to a surface of the shell 4 which faces the accommodation hole 42 and correspond to a surface opposite the outer surface 4*a* of the shell 4.

Referring to FIG. 8, the restriction member 431 may include the restriction surface 4311, the first dispersion surface 4312, and the second dispersion surface 4313.

The restriction surface 4311 performs a function of supporting the plug connector 200. The restriction surface 4311 is formed to be a flat surface so as to restrict movement of the plug connector 200 in the insertion direction (ID arrow direction) when the plug connector 200 comes into contact therewith. Accordingly, the receptacle connector 1 according to the present invention may implement a restricting force of restricting movement of the plug connector 200 using the restriction surface 4311. The restriction surface 4311 may be disposed between the first dispersion surface 4312 and the second dispersion surface 4313 and connected to the first dispersion surface 4312 and the second dispersion surface 4313. The restriction surface 4311 may be a surface of the restriction member 431 in the separation direction (SD arrow direction).

The restriction surface 4311 may be disposed to be spaced at a second distance D2 apart from the insertion reference surface IF on the basis of the second axial direction (Y-axis direction). In this case, the restriction surface 4311 and the facing surface 33 may be spaced at the same distance apart from the insertion reference surface IF on the basis of the second axial direction (Y-axis direction). That is, since the second distance D2 and the first distance D1 have the same value, the restriction surface 4311 may be disposed collinearly with the facing surface 33 on the basis of the second axial direction (Y-axis direction). Accordingly, the receptacle connector 1 according to the present invention may promote performance effects as follows.

First, the receptacle connector 1 according to the present invention is implemented to come into contact with the restriction surface 4311 and the facing surface 33 at the same time when the plug connector 200 is inserted into the shell 4 so that a pressure caused by insertion of the plug connector 200 is endured by the restriction surface 4311 and the facing surface 33. Accordingly, since the receptacle connector 1 according to the present invention is implemented to disperse a pressure in comparison to a case of being implemented such that only the facing surface 33 endures the pressure of the plug connector 200, it is possible to reduce a possibility of the facing surface 33 being damaged or destroyed by the pressure.

Second, the receptacle connector 1 according to the present invention may be implemented so that after the facing surface 33 is pressurized while the plug connector 200 is inserted into the shell 4, the restriction member 431 supports the plug connector 200 not to move further in the insertion direction (ID arrow direction). Accordingly, the receptacle connector 1 according to the present invention may increase a service life of the insulation portion 3 by preventing the facing surface 33 from being damaged or destroyed by a pressure caused by continuous movement of the plug connector 200 in the insertion direction (ID arrow direction). In addition, the receptacle connector 1 according to the present invention may further increase the service life of the insulation portion 3 by preventing the pressure of the plug connector 200 from being concentrated on the insulation portion 3 formed of a material having strength relatively lower than that of the shell 4.

The first dispersion surface 4312 is connected to the restriction surface 4311. The first dispersion surface 4312 is formed to be a curved surface and performs a function of dispersing a stress applied to the restriction member 431. When the plug connector 200 comes into contact with the first dispersion surface 4312, the first dispersion surface 4312 may disperse the stress applied to the restriction member 431. Accordingly, in comparison to a related art implemented to concentrate the stress on the restriction member 431, the receptacle connector 1 according to the present invention may provide a dispersion force of dispersing the stress applied to the restriction member 431 through the first dispersion surface 4312. The first dispersion surface 4312 may be connected to the restriction surface 4311 at one side of the restriction surface 4311. The first dispersion surface 4312 may be connected to the restriction surface 4311 and the inner surface 4*b* of the restriction surface 4311.

The restriction surface 4311 connected to the first dispersion surface 4312 may be at a right angle with the inner surface 4*b* of the shell 4. That is, the restriction surface 4311 may be connected to the first dispersion surface 4312 to be at a right angle with the inner surface 4*b* of the shell 4. Accordingly, the receptacle connector 1 according to the present invention may improve stability of an operation of supporting, by the restriction surface 4311, the plug connector 200. This is because in a comparative example in which the restriction surface 4311 is connected to the first dispersion surface 4312 to be inclined from the inner surface 4*b* of the shell 4, a possibility is present in which the plug connector 200 moves in the insertion direction (ID arrow direction) along the restriction surface 4311 during a process of being inserted into the accommodation hole 42. Accordingly, since the receptacle connector 1 according to the present invention is implemented so that the restriction surface 4311 is at a right angle with the inner surface 4*b* of the shell 4, a restriction force of the restriction surface 4311 which restricts a movable distance of the plug connector 200 may be improved. The inner surface 4*b* of the shell 4 may be formed to be parallel to the insertion direction (ID arrow direction).

The second dispersion surface 4313 is connected to the restriction surface 4311 at a position spaced apart from the first dispersion surface 4312. The second dispersion surface 4313 is formed to be a curved surface and performs a function of dispersing the stress applied to the restriction member 431. When the plug connector 200 comes into contact with the second dispersion surface 4313, the second dispersion surface 4313 may disperse the stress applied to the restriction member 431. Accordingly, in comparison to a related art implemented to concentrate the stress on the restriction member 431, the receptacle connector 1 according to the present invention may provide a dispersion force of dispersing the stress applied to the restriction member 431 through the second dispersion surface 4313. The second dispersion surface 4313 may be connected to the restriction surface 4311 on the other side of the restriction surface 4311. The second dispersion surface 4313, the first dispersion surface 4312, and the restriction surface 4311 may be connected to one another without a corner.

The second dispersion surface 4313, the first dispersion surface 4312, and the restriction surface 4311 may be connected to one another as a continuous surface. Accordingly, the receptacle connector 1 according to the present invention may be implemented so as to secure an adequate thickness 431D (refer to FIG. 8) of the restriction member 431 configured to restrict movement of the plug connector 200. In a conventional method of forming the restriction member 431, since a thickness of the shell body 41 has to correspond to the thickness 431D of the restriction member 431, a limitation is present in increasing the thickness 431D of the restriction member 431. The receptacle connector 1 according to the present invention may be implemented so that the second dispersion surface 4313, the first dispersion surface 4312 and the restriction surface 4311 are connected as a continuous surface without a gap so as to increase the thickness 431D of the restriction member 431. Accordingly, the receptacle connector 1 according to the present invention may improve a restriction force of the restriction member 431 which restricts movement of the plug connector 200. The thickness 431D of the restriction member 431 may correspond to a length of the restriction member 431 on the basis of the third axial direction (Z-axis direction).

The second dispersion surface 4313 and the first dispersion surface 4312 may be connected to different parts of the plug connector 200. Accordingly, the receptacle connector 1 according to the present invention may further reduce a possibility of damaging or destroying the restriction member 431 by extending an area capable of dispersing the stress using the dispersion surfaces 4312 and 4313.

Referring to FIGS. 7 and 8, the restriction portion 43 may include a rear member 432.

The rear member 432 is coupled with the restriction member 431. The rear member 432 and the restriction member 431 may be integrally formed without a joint. The rear member 432 may be disposed to the rear of the restriction member 431 and may provide a support force for supporting the plug connector 200 to the restriction member 431. Accordingly, the rear member 432 may support the restriction member 431 to the rear thereof to allow the restriction member 431 to adequately perform a restriction force of restricting a movable distance of the plug connector 200. The rear member 432 may be formed to extend along the insertion direction (ID arrow direction). The rear member 432 may extend in a direction parallel to the second axial direction (Y-axis direction). The rear may correspond to a direction which is the same as the insertion direction (ID arrow direction).

The rear member 432 may be formed to extend to the other end of the shell body 41 from the restriction member 431. Accordingly, the receptacle connector 1 according to the present invention may extend a support force of the rear member 432 which supports the restriction member 431 to the rear by increasing an area of the rear member 432. Accordingly, the receptacle connector 1 according to the present invention may improve stability in an operation of supporting, by the restriction member 431, the plug connector 200 by increasing the support force of the rear member 432 supporting the restriction member 431. One end and the other end of the shell 4 may be different parts of the shell 4 disposed at positions opposite each other.

Referring to FIGS. 2 to 11, when the shell 4 includes the restriction portion 43, the insulation portion 3 may include a fitting groove 34 (refer to FIG. 9).

The fitting groove 34 is a part into which the restriction portion 43 is inserted. As the restriction portion 43 is inserted into the fitting groove 34, the insulation portion 3 may be fit-coupled with the shell 4. Accordingly, the restriction portion 43 may be implemented to have a stopper function of restricting a movable distance of the plug connector 200 in the insertion direction (ID arrow direction) as well as a fixing function of fixing the insulation portion 3 to the shell 4. The fitting groove 34 may be formed to have a certain depth from a bottom surface of the first insulation member 31.

The fitting groove 34 may be formed to have a size corresponding to the restriction portion 43. The fitting groove 34 may be formed to have a size smaller than the restriction portion 43. For example, on the basis of a perpendicular cross section perpendicular to each of the first axial direction (X-axis direction) and the second axial direction (Y-axis direction), the fitting groove 34 may be formed to have a cross section area smaller than that of the restriction portion 43. Accordingly, the restriction portion 43 is inserted into the accommodation hole 42 to be inserted into the fitting groove 34 so that the insulation portion 3 may be coupled with the shell 4 using an interference fitting method. Accordingly, the receptacle connector 1 according to the present invention may be implemented to prevent a liquid, solid, and the like from permeating through a gap between the shell 4 and the insulation portion 3 so as to further reinforce a waterproof function. While the insulation portion 3 is being inserted into the accommodation hole 42, a part of the restriction portion 43 is stuck in the insulation portion 3 so that the insulation portion 3 may be more firmly coupled with the shell 4. The fitting groove 34 may be disposed in a part where the rear member 432 is formed on the basis of the second axial direction (Y-axis direction).

Referring to FIGS. 4, 7, and 9 to 11, the receptacle connector 1 according to the present invention may include a waterproof portion 5.

The waterproof portion 5 provides a waterproof function by sealing a gap between an outer surface of the insulation portion 3 and the inner surface 4*b* of the shell 4. The waterproof portion 5 may be formed to surround parts of the contacts 2 located outside the insulation portion 3 inside the shell 4 so as to provide a waterproof function for the contacts 2. The waterproof portion 5 may be located on the other end of the shell 4.

The waterproof portion 5 may be formed by applying and curing a potting solution to an inside of the shell 4 while the insulation portion 3 is inserted in the shell 4. The waterproof portion 5 may be disposed on a part where the restriction portion 43 is formed. Accordingly, on the basis of the perpendicular cross section, a volume inside the shell 4 to be filled with the potting solution may be reduced by the restriction portion 43. Accordingly, since an amount of the potting solution necessary for implementing the waterproof portion 5 may be reduced, the receptacle connector 1 according to the present invention may reduce a manufacturing cost for implementing the waterproof portion 5. The waterproof portion 5 may be disposed to be located to the rear of the insulation portion 3. FIG. 11 schematically illustrates an increased area IA of the potting solution to be filled inside the shell 4 in a comparative example without the restriction portion 43.

The waterproof portion 5 may include a reduction groove 51 (refer to FIG. 9). The reduction groove 51 is configured to reduce the potting solution used in forming the waterproof portion 5. Since the restriction member 431 is formed to protrude toward the accommodation hole 42, as the potting solution inside the shell 4 is cured, the reduction groove 51 may be formed. The reduction groove 51 may be formed to have a size corresponding to the restriction portion 43. The reduction groove 51 may be formed to have a size corresponding to the restriction portion 43 on the basis of the perpendicular cross section. The reduction groove 51 may be disposed in a part where the rear member 432 is formed on the basis of the second axial direction (Y-axis direction). The reduction groove 51 may be formed to have a certain depth from a bottom surface of a waterproof body 50. The waterproof body 50 may form an overall exterior of the waterproof portion 5.

Hereinafter, two embodiments of the restriction portion 43 in the receptacle connector 1 according to a modified embodiment of the present invention will be sequentially described. The restriction portion 43 of the receptacle connector 1 according to the modified embodiment of the present invention is implemented to be approximately equal to the above-described restriction portion 43 of the receptacle connector 1 according to the present invention, and differences therebetween will be mainly described below.

First Embodiment

Referring to FIG. 12, a plurality of such restriction portions 43 may protrude toward the accommodation hole 42. Although it is shown in FIG. 12 that two restriction portions 43*a* and 43*b* protrude toward the accommodation hole 42, this is merely an example and three or more restriction portions 43 may protrude toward the accommodation hole 42. The two restriction portions 43*a* and 43*b* may protrude toward the accommodation hole 42 from one part and another part of the accommodation hole 42. The one part of the accommodation hole 42 and the other part of the accommodation hole 42 may be spaced apart from each other on the basis of an intermediate part of the shell 4 in the first axial direction (X-axis direction). When the plurality of restriction portions 43 protrude toward the accommodation hole 42, a plurality of such restriction members 431 and a plurality of such rear members 432 may protrude from the accommodation hole 42.

According to the restriction portions 43*a* and 43*b* protruding toward the accommodation hole 42, the restriction members 431 support different parts of the plug connector 200 at different positions so as to restrict a movable distance of the plug connector 200. Accordingly, the receptacle connector 1 according to the modified embodiment of the present invention may promote performance effects as follows.

The receptacle connector 1 according to the modified embodiment of the present invention may increase an area of the restriction surface 4311, which supports the plug connector 200, through the plurality of restriction portions 43*a* and 43*b*. Accordingly, the receptacle connector 1 according to the modified embodiment of the present invention may implement a restricting force of the restriction surface 4311 which restricts the movable distance of the plug connector 200.

Second, the receptacle connector 1 according to the modified embodiment of the present invention may induce the plug connector 200 to be inserted in a direction parallel to the insertion direction (ID arrow direction) using the restriction portions 43*a* and 43*b* even when the plug connector 200 is inserted to be inclined to the insertion direction (ID arrow direction) while the plug connector 200 is inserted into the accommodation hole 42. This will be described in detail as follows. For convenience of understanding, any one of the restriction portions 43*a* and 43*b* will be referred to as a first restriction portion 43*a* and the other will be referred to as a second restriction portion 43*b*.

When the plug connector 200 is inserted into the accommodation hole 42 to be inclined to the insertion direction (ID arrow direction), one side of the plug connector 200 may first come into contact with the first restriction portion 43*a*. In this case, one side of the plug connector 200 is supported by the first restriction portion 43*a* not to move further in the insertion direction (ID arrow direction). When the plug connector 200 is continuously inserted in the insertion direction (ID arrow direction) while one side of the plug connector 200 is supported by the first restriction portion 43*a*, the other side of the plug connector 200 may move to be inserted in a direction parallel to the insertion direction (ID arrow direction) and be supported by the second restriction portion 43*b*. Accordingly, the one side and the other side of the plug connector 200 are supported by the restriction portions 43*a* and 43*b*, respectively, so as to restrict the movable distance thereof. As described, the receptacle connector 1 according to the modified embodiment of the present invention may induce the plug connector 200 to be inserted in a direction parallel to the insertion direction (ID arrow direction) using the restriction portions 43*a* and 43*b* even when the plug connector 200 is inserted to be inclined to the insertion direction (ID arrow direction) due to carelessness of a worker and the like while the connector 200 is inserted into the accommodation hole 42. Accordingly, the receptacle connector 1 according to the modified embodiment of the present invention may improve ease in an operation of inserting the plug connector 200 into the accommodation hole 42.

Third, in the receptacle connector 1 according to the modified embodiment of the present invention, since a part where the restriction portion 43 is formed inside the shell 4 is increased, a volume of the potting solution which the shell 4 is to be filled with may be reduced. That is, the receptacle connector 1 according to the modified embodiment of the present invention may reduce the increased area IA shown in FIG. 11. Accordingly, since an amount of the potting solution for implementing the waterproof portion 5 may be reduced, the receptacle connector 1 according to the modified embodiment of the present invention may reduce a manufacturing cost for implementing the waterproof portion 5.

Second Embodiment

Referring to FIG. 13, the restriction portion 43 may be formed to extend along the first axial direction (X-axis direction). The restriction portion 43 may extend from one part toward another part of the accommodation hole 42.

As the restriction portion 43 extends in the first axial direction (X-axis direction), the restriction member 431 may restrict a movable distance of the plug connector 200 by supporting one side and the other side of the plug connector 200. Accordingly, the receptacle connector 1 according to the modified embodiment of the present invention may promote performance effects as follows.

First, the receptacle connector 1 according to the modified embodiment of the present invention may extend an area of the restriction surface 4311, which supports the plug connector 200, through the restriction portion 43 formed to extend in the first axial direction (X-axis direction). Accordingly, the receptacle connector 1 according to the modified embodiment of the present invention may implement a restricting force of the restriction surface 4311 which restricts the movable distance of the plug connector 200.

Second, the receptacle connector 1 according to the modified embodiment of the present invention may induce the plug connector 200 to be inserted in a direction parallel to the insertion direction (ID arrow direction) using the restriction portion 43 extending in the first axial direction (X-axis direction) even when the plug connector 200 is inserted to be inclined to the insertion direction (ID arrow direction) due to carelessness, improper operation of a worker and the like while the connector 200 is inserted into the accommodation hole 42. Accordingly, the receptacle connector 1 according to the modified embodiment of the present invention may improve ease in an operation of inserting the plug connector 200 into the accommodation hole 42.

Third, in the receptacle connector 1 according to the modified embodiment of the present invention, since a part where the restriction portion 43 is formed inside the shell 4 is increased, a volume of the potting solution to be filled inside the shell 4 may be reduced. Accordingly, since an amount of the potting solution for implementing the waterproof portion 5 may be reduced, the receptacle connector 1 according to the modified embodiment of the present invention may reduce a manufacturing cost for implementing the waterproof portion 5.

Referring to FIGS. 2 to 4, 14, and 16, the receptacle connector 1 according to the present invention may include a cover 6.

The cover 6 is configured to protect the shell 4. The cover 6 may be coupled with the shell 4 to surround the outer surface 4*a* of the shell 4. The shell 4 may be coupled with the cover 6 to be located inside the cover 6. The cover 6 may be coupled to be fixed to the substrate. The cover 6 may be mounted on the substrate using a surface mount technology to be coupled to be fixed to the substrate. The cover 6 may be coupled to be fixed to the substrate by inserting a fastening member (not shown) such as a bolt into a fastening hole 6A (refer to FIGS. 2 and 3). The cover 6 and the shell 4 may be coupled by performing partial welding thereon. The shell 4 may be installed in the cover 6 to protrude from the cover 6.

The cover 6 may include an upper cover 61 (refer to FIG. 4) and a lower cover 62 (refer to FIG. 4).

The upper cover 61 is configured to protect the shell 4 on a top surface of the shell 4. The lower cover 62 is configured to protect the shell 4 on a bottom surface of the shell 4. The top surface of the shell 4 means one surface opposite a surface where the receptacle connector 1 according to the present invention is coupled with the substrate, and the bottom surface of the shell 4 means the other surface where the receptacle connector 1 according to the present invention is coupled with the substrate. However, the present invention is not limited thereto.

Accordingly, the receptacle connector 1 according to the present invention may promote performance effects as follows.

The receptacle connector 1 according to the present invention is implemented so that the cover 6 is not integrally formed and includes the upper cover 61 and the lower cover 62. Accordingly, in comparison to a comparative example in which the cover 6 is integrally formed and coupled with the shell 4, the receptacle connector 1 according to the present invention has an advantage of reducing a processing cost by decreasing a defect rate of a product.

That is, in the comparative example, the integrally formed cover 6 is coupled with the shell 4 to be located outside the shell 4. In this case, when the cover 6 is not formed to have an accurate size capable of surrounding the outer surface 4*a* of the shell 4 due to a manufacturing tolerance and the like, the cover 6 is abandoned as a defective product. In detail, when the cover 6 is formed to be smaller than an outside of the shell 4, the cover 6 may not cover the outside of the shell 4. When the cover 6 is formed to have a certain size greater than the outside of the shell 4 in consideration of a manufacturing error in this case, since the shell 4 cannot be stably fixed due to a gap between the cover 6 and the shell 4, the cover 6 is faulty. However, in the receptacle connector 1 according to the present invention, the cover 6 includes the upper cover 61 and the lower cover 62. The upper cover 61 and the lower cover 62 are coupled with the shell 4 to press against the shell 4 at a top and a bottom of the shell 4 so that there is an advantage of reducing a manufacturing cost by a decreasing a defect rate of a product in comparison to a comparative example.

Referring to FIGS. 4, 7, 15, and 17, the receptacle connector 1 according to the present invention may include a sealing member 7.

The sealing member 7 implements a waterproof function. The sealing member 7 may be coupled with the shell 4 in front of the shell 4. The sealing member 7 presses against a frame (not shown) of an electronic device so as to prevent water and the like from permeating into the shell 4. Accordingly, even in a relationship with the electronic device, the receptacle connector 1 according to the present invention may be implemented to have a waterproof function so as to contribute to improving waterproof performance with respect to the electronic device. The sealing member 7 may be installed in the shell 4 to surround the outer surface 4*a* of the shell 4. The sealing member 7 may be formed to have an overall elliptical ring shape. The front may correspond to a direction which is the same as the separation direction (SD arrow direction). The frame may be a case belonging to the electronic device.

When the receptacle connector 1 according to the present invention includes the sealing member 7, the shell 4 may include a support portion 44 for supporting the sealing member 7.

Referring to FIGS. 5, 7, and 14 to 17, the support portion 44 is configured to support the sealing member 7. The sealing member 7 may be coupled with the support portion 44. Accordingly, the receptacle connector 1 according to the present invention is implemented to restrict a rearward movable distance of the sealing member 7 using the support portion 44. Accordingly, the receptacle connector 1 according to the present invention may prevent the sealing member 7 coupled with the support portion 44 from being separated therefrom due to vibrations, shaking, and the like which occur during a process of inserting the plug connector 200, a process of using the electronic device, and the like. Accordingly, the receptacle connector 1 according to the present invention may be implemented to firmly maintain a state in which the sealing member 7 coupled with the support portion 44 seals a gap between the shell 4 and the electronic device. The support portion 44 and the shell body 41 may be integrally formed without a joint. The support portion 44 may protrude toward the front of the cover 6 and be located outside the cover 6. The support portion 44 may be located on the other end of the shell body 41.

Referring to FIGS. 14 to 17, the support portion 44 may include a support member 441 and a support protrusion 442.

The support member 441 is configured to support the sealing member 7. The sealing member 7 may be coupled with the support member 441. The shell 4 may be coupled with the cover 6 so that the support member 441 protrudes frontward from the cover 6 and is located outside the cover 6. Accordingly, the support member 441 may support the sealing member 7 so that the sealing member 7 seals a gap between the shell 4 and the electronic device from the outside of the cover 6.

The support member 441 may be coupled with the shell body 41 to protrude frontward from the shell body 41. The shell 4 may be coupled with the cover 6 so that the support member 441 is located outside the cover 6 and the shell body 41 is located inside the cover 6. The support member 441 and the shell body 41 may be integrally formed. The support member 441 may extend in a direction parallel to the second axial direction (Y-axis direction).

The support member 441 may be formed to have a length longer than that of the sealing member 7 to be located in front of the sealing member 7. For example, the support member 441 may be formed to be longer than the sealing member 7 on the basis of the second axial direction (Y-axis direction). Accordingly, the end of the support member 441 may be located in front of the sealing member 7. Accordingly, the receptacle connector 1 according to the present invention may prevent the sealing member 7 coupled with the support member 441 from being separated therefrom due to vibrations, shaking, and the like which occur during a process of inserting or separating the plug connector 200, a process of using the electronic device, and the like by increasing a support area of the support member 441 on the basis of the second axial direction (Y-axis direction).

Referring to FIGS. 14 to 17, the support protrusion 442 is configured to restrict a movable distance of the sealing member 7. The support protrusion 442 may protrude outward from the support member 441 so as to restrict a rearward movable distance of the sealing member 7. The support protrusion 442 may restrict the rearward movable distance of the sealing member 7 by supporting the sealing member 7 to the rear of the sealing member 7. Accordingly, the receptacle connector 1 according to the present invention may be implemented to firmly maintain a state in which the sealing member 7 seals the gap between the shell 4 and the electronic device by preventing the sealing member 7 from being separated due to vibrations, shaking, and the like which occur in the process of inserting or separating the plug connector, the process of using the electronic device, and the like.

The support protrusion 442 is coupled with the support member 441. The shell 4 may be coupled with the cover 6 so that the support protrusion 442 protrudes frontward from the cover 6 and is located outside the cover 6.

The support protrusion 442 may be coupled with the support member 441 to protrude outward from the support member 441. The support protrusion 442 may be coupled with the support member 441 to protrude from the support member 441 in the third axial direction (Z-axis direction). Accordingly, the receptacle connector 1 according to the present invention may form a sectional thickness of the sealing member 7 as thick as a height of the support protrusion 442 protruding from the support member 441. The support protrusion 442 may be formed on an outer surface of the support member 441 along a circumferential direction of the support member 441. The support protrusion 442 may be formed to have an overall elliptical ring shape but is not limited thereto and may be formed to have any shape capable of supporting the sealing member 7.

The support protrusion 442 may be formed to protrude outward from the support member 441 to come into contact with the frame of the electronic device and to seal a gap between the outer surface 4*a* of the shell 4 and the frame. When an insertion hole into which the support protrusion 442 is inserted is formed in the frame, a size of the support protrusion 442 may be implemented to be equal to a size of the insertion hole. Accordingly, the support protrusion 442 is inserted into the insertion hole and presses against the frame so as to seal the gap between the outer surface 4*a* of the shell 4 and the frame. The size of the support protrusion 442 may be implemented to be greater than the size of the insertion hole. In this case, the support protrusion 442 may be fixed to the frame using an interference fitting method so as to further increase a sealing force between the outer surface 4*a* of the shell 4 and the frame.

The support protrusion 442 may be coupled with the support member 441 to protrude further outward from the support member 441 in comparison to the sealing member 7. That is, on the basis of the third axial direction (Z-axis direction), a length 442H of the support protrusion 442 protruding from the support member 441 is formed to be longer than a length 7H of the sealing member 7 coupled with the support member 441. Accordingly, the receptacle connector 1 according to the present invention may prevent the sealing member 7 from being separated from the support protrusion 442 and moving toward the rear of the support protrusion 442 during a process of inserting the plug connector. However, the present invention is not limited thereto, and the support protrusion 442 may be formed to protrude outward from the support member 441 by as much as a length of the sealing member 7 protruding outward from the support member 441. The support protrusion 442, the support member 441, and the shell body 41 may be integrally formed.

Referring to FIGS. 14 and 15, the support member 441 may be formed to have a thickness greater than that of the shell body 41. That is, the support member 441 may be formed to have a length formed along the third axial direction (Z-axis direction) which is longer than that of the shell body 41. In this case, the support member 441 may include a first support member 441*a*, the second support member 441*b*, and a connection-support member 441*c*.

The first support member 441*a* may be formed to extend from the shell body 41. The first support member 441*a* may be formed to extend frontward from the shell body 41. The first support member 441*a* may support the second support member 441*b* inside the second support member 441*b*.

The second support member 441*b* may support the sealing member 7. The sealing member 7 may be coupled with the second support member 441*b* and be supported by the second support member 441*b*. The second support member 441*b* may support the sealing member 7 outside the first support member 441*a*.

The connection-support member 441*c* is configured to connect the first support member 441*a* and the second support member 441*b*. The connection-support member 441*c* may be coupled with each of the first support member 441*a* and the second support member 441*b* so as to connect the first support member 441*a* and the second support member 441*b*. The connection-support member 441*c* may be formed in the third axial direction (Z-axis direction) so as to connect the first support member 441*a* and the second support member 441*b*. Accordingly, the second support member 441*b* may support the sealing member 7 outside the first support member 441*a*. The support protrusion 442 may be coupled with the second support member 441*b* to protrude outward from one end of the second support member 441*b* not connected to the connection-support member 441*c*.

The connection-support member 441*c*, the second support member 441*b*, and the first support member 441*a* may be integrally formed. In this case, the support member 441 may be formed to include the connection-support member 441*c*, the second support member 441*b*, and the first support member 441*a* by bending a panel. Accordingly, the connection-support member 441*c* may be formed so that a surface facing the front forms a curve.

Also, as described above, the shell body 41, the support member 441, and the support protrusion 442 may be integrally formed. In this case, the shell 4 may be formed to include the support member 441 including the connection-support member 441*c*, the second support member 441*b*, and the first support member 441*a*, the shell body 41, and the support protrusion 442 by bending a panel.

Accordingly, since it is possible to form a structure configured to reduce the number of operations as well as support the sealing member 7 in comparison to a comparative example of separately forming the support member 441 and the support protrusion 442 on the shell body 41, the receptacle connector 1 according to the present invention may reduce manufacturing costs and increase productivity by reducing a manufacturing time.

Also, the receptacle connector 1 according to the present invention may prevent a size of the shell body 41 from being increased by forming the support member 441 and the support protrusion 442 by bending an end of the panel 10 shown in FIG. 6. Accordingly, in comparison to a comparative example of forming a step between the support member 441 and the shell body 41 by increasing a thickness of the shell body 41 to support the sealing member 7, the receptacle connector 1 according to the present invention has an advantage of implementing miniaturization.

In the embodiment, the support member 441 and the support protrusion 442 are formed by bending ends of the panel so that the support member 441 is formed to have a thickness greater than that of the shell body 41. However, the present invention is not limited thereto.

For example, referring to FIGS. 16 and 17, the receptacle connector 1 according to another embodiment of the present invention may be formed so that the support member 441 has the same thickness as that of the shell body 41. In this case, the support protrusion 442 may include a first support protrusion 442*a*, a second support protrusion 442*b*, and a connection-support protrusion 442*c*.

The first support protrusion 442*a* may be formed to extend from the shell body 41. The first support protrusion 442*a* may be formed to protrude outward from the shell body 41. The first support protrusion 442*a* may support the second support protrusion 442*b* from the rear of the second support protrusion 442*b*.

The second support protrusion 442*b* is formed in front of the first support protrusion 442*a*. The second support protrusion 442*b* may be disposed to be parallel to the first support protrusion 442*a* to restrict a rearward movable distance of the sealing member 7. Accordingly, in comparison to a comparative example of restricting movement of the sealing member 7 using only the first support protrusion 442*a* or the second support protrusion 442*b*, the receptacle connector 1 according to the present invention may more stably restrict movement of the sealing member 7.

The connection-support protrusion 442*c* is configured to connect the first support protrusion 442*a* and the second support protrusion 442*b*. The connection-support protrusion 442*c* may be coupled with each of the first support protrusion 442*a* and the second support protrusion 442*b* so as to connect the first support protrusion 442*a* and the second support protrusion 442*b*. The connection-support protrusion 442*c* may be formed in the second axial direction (Y-axis direction) so as to connect the first support protrusion 442*a* and the second support protrusion 442*b*. The connection-support protrusion 442*c* may connect the first support protrusion 442*a* and the second support protrusion 442*b* on an exterior of the first support protrusion 442*a* and the second support protrusion 442*b*. The support member 441 may be formed on the second support protrusion 442*b* to protrude frontward from one end of the second support protrusion 442*b* which is not connected to the connection-support protrusion 442*c*.

The connection-support protrusion 442*c*, the second support protrusion 442*b*, and the first support protrusion 442*a* may be integrally formed. In this case, the support protrusion 442 may be formed to include the connection-support protrusion 442*c*, the second support protrusion 442*b*, and the first support protrusion 442*a* by bending a panel. Accordingly, the connection-support protrusion 442*c* may be formed so that an outward surface forms a curve.

Also, as described above, the shell body 41, the support member 441, and the support protrusion 442 may be integrally formed. In this case, the shell 4 may be formed to include the support protrusion 442 including the connection-support protrusion 442*c*, the second support protrusion 442*b*, and the first support protrusion 442*a*, the support member 441, and the shell body 41 by pressurizing a panel.

Accordingly, since it is possible to form a structure configured to reduce the number of operations as well as support the sealing member 7 in comparison to a comparative example of separately forming the support protrusion 442 on the shell body 41, the receptacle connector 1 according to the present invention may reduce manufacturing costs and increase productivity by reducing a manufacturing time.

Also, the receptacle connector according to the present invention may prevent the size of the shell body 41 from being increased by forming the support protrusion 442 by pressurizing the panel. Accordingly, in comparison to a comparative example of forming a step between the support member 441 and the shell body 41 by increasing a thickness of the shell body 41 to support the sealing member 7, the receptacle connector 1 according to the present invention has an advantage of implementing miniaturization.

While the exemplary embodiments of the present invention and their advantages have been described in detail with reference to the accompanying drawings, it will be apparent to those skilled in the art to which the present invention belongs that various changes, substitutions and alterations may be made herein without departing from the scope of the present invention.

The invention claimed is:

1. A receptacle connector comprising:

a plurality of contacts configured to electrically connect a plug connector and a substrate coupled with an electronic device;

an insulation portion with which the contacts are coupled; and a shell with which the insulation portion is coupled, wherein the shell comprises a shell body, in which an accommodation hole configured to allow the plug connector to be inserted therein is formed, and a restriction portion configured to protrude toward the accommodation hole to restrict a movable distance of the plug connector in an insertion direction in which the plug connector is inserted into the accommodation hole, wherein the shell body and the restriction portion are integrally formed without a joint, wherein the restriction portion comprises a restriction member for supporting the plug connector, wherein the restriction member comprises a restriction surface for supporting the plug connector, a first dispersion surface connected to the restriction surface, and a second dispersion surface connected to the restriction surface at a position which is spaced apart from the first dispersion surface, and wherein the restriction surface is formed to be flat surface, wherein the second dispersion surface and the first dispersion surface are formed to be curved surfaces.

2. The receptacle connector of claim 1, wherein the restriction surface extends from an inner surface of the shell facing the accommodation hole toward a bottom surface of the insulation portion.

3. The receptacle connector of claim 1, wherein the restriction portion comprises a rear member integrated with the restriction member without a joint, and wherein the rear member is disposed to a rear of the restriction member and provides a support force for supporting the plug connector to the restriction member.

4. The receptacle connector of claim 1, wherein the second dispersion surface, the first dispersion surface, and the restriction surface are connected to one another as a continuous surface.

5. The receptacle connector of claim 1, wherein the shell comprises an insertion reference surface (IF) from which insertion of the plug connector starts, wherein the insulation portion comprises a facing surface facing the plug connector, and wherein the facing surface and the restriction surface are spaced the same distance apart from the insertion reference surface (IF).

6. The receptacle connector of claim 1, wherein the insulation portion comprises a fitting groove into which the restriction portion is inserted and is fit-coupled with the shell by inserting the restriction portion into the fitting groove.

7. The receptacle connector of claim 1, further comprising a waterproof portion configured to seal a gap between an outer surface of a first insulation member included in the insulation portion and an inner surface of the shell.

8. The receptacle connector of claim 1, wherein a plurality of such restriction portions protrude toward the accommodation hole, and wherein the restriction members support different parts of the plug connector at positions spaced apart from each other so as to restrict a movable distance of the plug connector.

9. The receptacle connector of claim 1, further comprising:

a cover with which the shell is coupled; and a sealing member coupled with the shell to seal a gap between the electronic device and the shell, wherein the shell comprises a support portion integrated with the shell body without a joint to support the sealing member, and is coupled with the cover so that the support portion protrudes toward a front of the cover and is located outside the cover, wherein the support portion comprises a support member protruding toward a front of the shell body and a support protrusion protruding outward from the support member and coupled with the support member to restrict a rearward movable distance of the sealing member, and wherein the support member is formed to have a thickness greater than that of the shell body.

10. The receptacle connector of claim 9, wherein the support member comprises:

a first support member formed to extend frontward from the shell body;

a second support member with which the sealing member is coupled, and a connection-support member configured to connect the first support member and the second support member so that the second support member is located outside the first support member, and wherein the support protrusion protrudes outward from one end of the second support member not connected to the connection-support member and is coupled with the second support member to restrict the rearward movable distance of the sealing member.

11. The receptacle connector of claim 1, further comprising:

a cover with which the shell is coupled; and a sealing member coupled with the shell to seal a gap between the electronic device and the shell, wherein the shell comprises a support portion integrated with the shell body without a joint to support the sealing member, and is coupled with the cover so that the support portion protrudes toward a front of the cover and is located outside the cover, wherein the support portion comprises a support member configured to protrude toward a front of the shell body and a support protrusion configured to protrude outward from the support member and coupled with the support member to restrict a rearward movable distance of the sealing member, and wherein the support member is formed to have a thickness equal to that of the shell body.

12. The receptacle connector of claim 11, wherein the support protrusion comprises:

a first support protrusion formed to protrude outward from the shell body;

a second support protrusion formed in front of the first support protrusion; and a connection-support protrusion configured to connect the first support protrusion and the second support protrusion on an exterior of the first support protrusion and the second support protrusion, and wherein the support member is formed to protrude frontward from one end of the second support protrusion not connected to the connection-support protrusion.

* * * * *